US006092846A

United States Patent [19]

Fuss et al.

[11] Patent Number: 6,092,846

[45] Date of Patent: Jul. 25, 2000

[54] LOCKING DEVICE, IN PARTICULAR FOR FURNITURE

[75] Inventors: Fritz Helmut Fuss, Albstadt; Augustin Toma, Balingen, both of Germany

[73] Assignee: EFF-EFF Fritz Fuss GmbH & Co., Albstatt-Ebingen, Germany

[21] Appl. No.: 09/109,837

[22] Filed: Jul. 2, 1998

[30] Foreign Application Priority Data

Jul. 2, 1997 [DE] Germany ..... 197 28 273

[51] Int. Cl.[7] ..... E05C 19/00

[52] U.S. Cl. ..... 292/302; 292/341.16; 292/144; 292/DIG. 60

[58] Field of Search ..... 292/302, 341.16, 292/341.15, 341.18, 144, 150, 244, DIG. 60, DIG. 69, DIG. 53, DIG. 5; 70/34, 380; 403/217

[56] References Cited

U.S. PATENT DOCUMENTS 3,837,754 9/1974 Malcik ..... 403/217
4,613,176 9/1986 Kelly ..... 292/201
4,616,863 10/1986 Bryant ..... 292/302

*Primary Examiner*—B. Dayoan
*Assistant Examiner*—Clifford B Vaterlaus
*Attorney, Agent, or Firm*—Elizabeth Stanley; Pepper Hamilton LLP

[57] ABSTRACT

An electrically actuable furniture locking device includes a locking housing, a locking pin and an indicator element. The locking housing is provided with two introduction openings for a locking pin. In the locking housing, a locking slide is arranged to be actuated electromagnetically and adjusted from a locking position into an unlocking position. A lever armature, which can be connected to the locking slide, can be connected to the locking slide such that it can be optionally switched over for closed-circuit or open-circuit operation. The locking device permits an arrangement adaptable to various installations, as well as monitoring of the open and closed states and optionally closed- and open-circuit operations.

22 Claims, 8 Drawing Sheets

LOCKING DEVICE, IN PARTICULAR FOR FURNITURE

RELATED APPLICATIONS

This application claims priority from German Patent Application Number 19728273.3 filed on Jul. 2, 1997 of which is hereby incorporated by reference.

FIELD OF THE INVENTION

The invention relates to a locking device for furniture, in particular for cabinets, desks, chests, display cases, base units and the like, according to the preamble of claim 1.

The invention also relates to a locking device for locking and unlocking two components which can be moved relative to one another, in particular doors or drawers of furniture, having a locking element, which can be secured on a first component, and a locking-element socket, which can be secured on a second component and can be moved from a position in which it locks the locking element into an unlocking position.

BACKGROUND OF THE INVENTION

Electrically actuable locking devices for furniture are described in DE 41 01 744 A1. In a first variant, a so-called spring catch with a catch bolt is fastened, as locking element, on a movable part of a piece of furniture, e.g. on a door or a drawer. The locking-element socket provided is a door opener latch, which is arranged on a stationary furniture part. A closed position or open position of the door opener latch for locking or unlocking the door or a drawer is achieved with the aid of an armature and an electromagnet.

This known locking device may be equipped either with an open-circuit door opener latch or with a closed-circuit door opener latch. Optional, switch-over open-circuit operation or closed-circuit operation is not possible.

In a further variant, the locking element provided is a locking bolt which, in the direction of its longitudinal axis, can be moved to a lower, open position and into a closed position with the aid of a drive. In the closed position, the locking bolt engages in a mating element, which is fastened on a stationary furniture part.

As a result of the design, the known locking devices can only be fastened in one position on the stationary and movable furniture part. Optional arrangement of the locking device in accordance with the different conditions and furniture configurations is not possible.

One object of the invention is to provide a furniture-locking device which can be actuated electrically and permits an arrangement which is adapted to the various installation situations, as well as, simultaneously, monitoring of the open state and locked state.

A further object of the invention is to provide a locking device which is intended for locking and unlocking two components, which can be moved relative to one another, and of which the design permits optionally closed-circuit operation or open-circuit operation.

The first object is achieved according to the invention by a locking device having the features of claim 1. Expedient and advantageous configurations form the subject-matter of the subclaims and are contained in the description of the figures.

An essential basic idea of the invention is that a locking element of defined design interacts with a locking-element socket which, for optional arrangement of the locking device, has two sockets for the locking element. According to the invention, the locking element provided is a locking pin and the locking-element socket provided is a locking slide arranged in a locking housing. The locking slide is of virtually cuboidal or cubic design and is arranged in the vicinity of an end side and of an adjoining housing wall of the locking housing, so as to ensure a vertical adjusting movement with guidance on at least one housing wall, in particular on a covering.

According to the invention, two introduction openings are formed in the locking housing and, in the unlocking position, these are aligned, or arranged congruently, with sockets of the locking slide, which adjoins on the inside.

If in each case one introduction opening and one socket, preferably a vertically arranged slot, for a locking pin is provided on an end side and on a front side of the locking housing and of the locking slide, which abuts on the inside, then account can be taken of the different installation situations in each case and the locking device according to the invention can be fastened as required on a piece of furniture or else on other lockable structures, such as safe-deposit boxes, left-luggage lockers or the like.

A locking position and unlocking position are achieved, once the locking pin has been introduced, by vertical adjustment of the locking slide. The locking slide is actuated by an armature/coil device. The locking slide is designed such that locking and unlocking operations can optionally be adjusted in accordance with the closed-circuit principle (unlocked when not supplied with current) and in accordance with the open-circuit principle (locked when not supplied with current).

The closed-circuit principle or open-circuit principle can be predetermined particularly advantageously by an armature of the electromagnet being "switched over".

According to the invention, for the purpose of monitoring the presence of a locking pin, an indicator element is arranged at the point of intersection, of the axes of the two introduction openings or of the sockets of the locking slide and, when a locking pin has been pushed in, to be precise irrespective of the introduction opening, said indicator element is displaced counter to a compression spring and actuates a switch in the process.

The switch is expediently a microswitch and is connected to a monitoring or alarm system, with the result that both the locked state, in which the indicator element is displaced downward counter to the force of a spring supported on the housing, and the unlocked state, in which the indicator element is forced by a spring to project into the socket, are registered.

The locking pin is designed in the form of a circular cylinder and projects approximately at right angles from a fastening flange with fastening openings. It is advantageous for the locking pin to be fastened releasibly in a cutout of the fastening flange and for the cutout to be designed preferably with a relatively large diameter, with the result that the locking pin can be displaced, in order to compensate for tolerances, and fastened thereafter. The locking pin is preferably provided with a frustoconical introduction region, in order to come into contact with the introduction opening when the tolerance region is being utilized.

The locking pin also has a locking groove, in the vicinity of the fastening-flange end, and an indicator groove, in the vicinity of the free end. With the locking slide displaced appropriately, the locking groove and the adjoining blocking surfaces engage behind the slot opening of said locking slide, with the result that it is not possible for the locking pin to be drawn out of the locking slide and out of the locking housing. This means that a locking position has been achieved.

The indicator groove serves for the engagement of the indicator element. For this purpose, the indicator element, which is designed virtually in the form of a circular cylinder, has an approximately hemispherical head region, which is designed to be virtually complementary to the indicator groove. By virtue of the engagement of the indicator element in the indicator groove of the locking pin, the indicator element acts, at the same time, as a latching element and thus also fulfills the function of a "latch-in ball".

The locking pin is advantageously provided with a front introduction region in the form of a truncated cone. The introduction openings in the locking housing are of complementary design and taper in the direction of the locking slide.

The locking housing is closed on all sides and has fastening openings at least in a base surface. The locking housing is usually fastened in a stationary manner on a piece of furniture, while the locking pin is fastened on the movable furniture part. However, it is also conceivable for this arrangement to be swapped round.

The locking slide is adjusted with the aid of an armature, which is of bar-like design and can be pivoted about a pivot axis. The armature is expediently designed as a single-arm lever. One or even two coils of an electromagnet is/are arranged in the vicinity of the pivot axis. A free end region of the armature is fixed, e.g. suspended, in complementary grooves, namely in an open-circuit groove or in a closed-circuit groove of the locking slide. Since fastening can be performed as required, it is possible to change over from closed-circuit operation to open-circuit operation and vice versa.

According to the invention, the second object is achieved by a locking device having the features of claim 14. This locking device, which is mentioned in the introduction, is defined in that the locking element provided is a locking pin and the locking-element socket provided is a locking housing with an electrically actuable locking slide, and in that, by virtue of setting the relative positions of interacting locking parts of the locking pin and of the locking slide, it is possible to set optionally open-circuit operation, in which the locking pin is locked when the actuating device has not been supplied with current, and closed-circuit operation, in which the locking pin is unlocked when the actuating device has not been supplied with current.

The possibility of optionally setting open-circuit operation or closed-circuit operation means that the necessary range of variants and types is reduced to a considerable extent. Setting can be carried out when the locking device is first fitted on components, furniture, safe-deposit boxes, left-luggage lockers, drawers and the like or else is straightforward to change over at a later stage as required.

Advantageous configurations of the invention are specified in the associated dependent claims.

BRIEF DESCRIPTION OF THE DRAWINGS

The locking device according to the invention and the functioning thereof are explained in more detail hereinbelow by way of exemplary embodiments and with reference to drawings, in which, schematically:

DETAILED DESCRIPTION OF THE INVENTION

Figure 1:
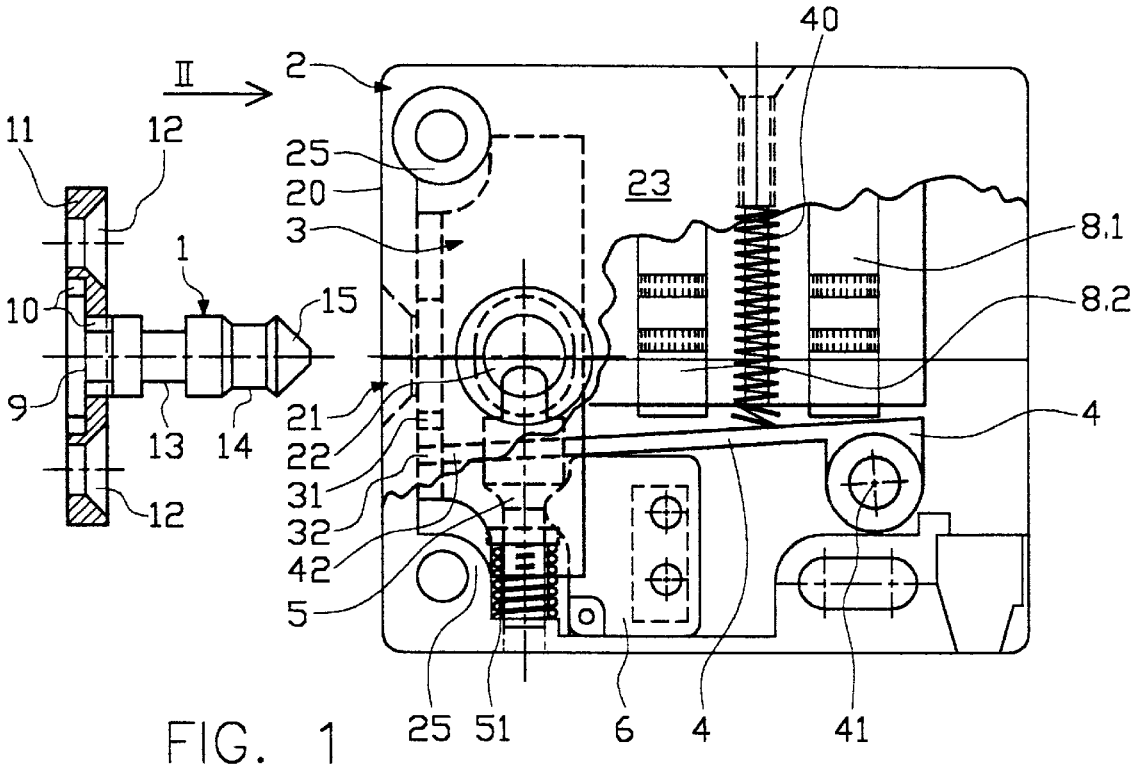
Figure 2:
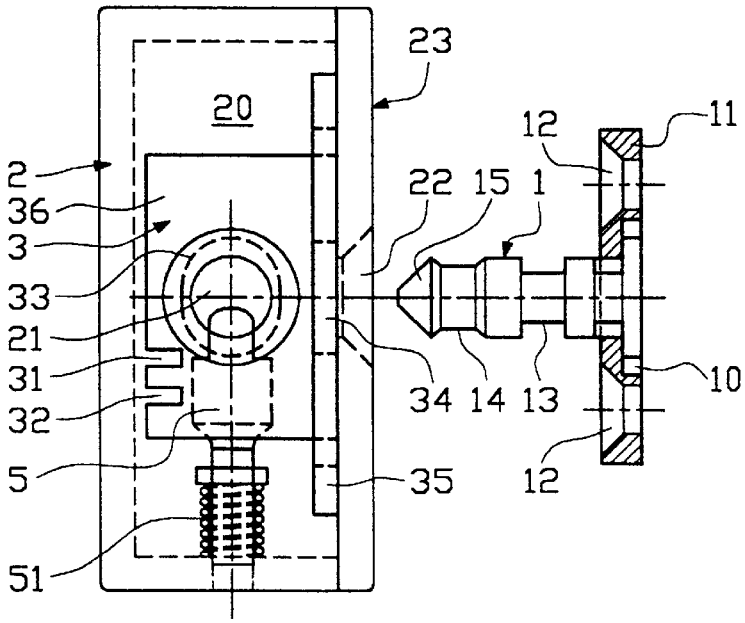
Figure 3:
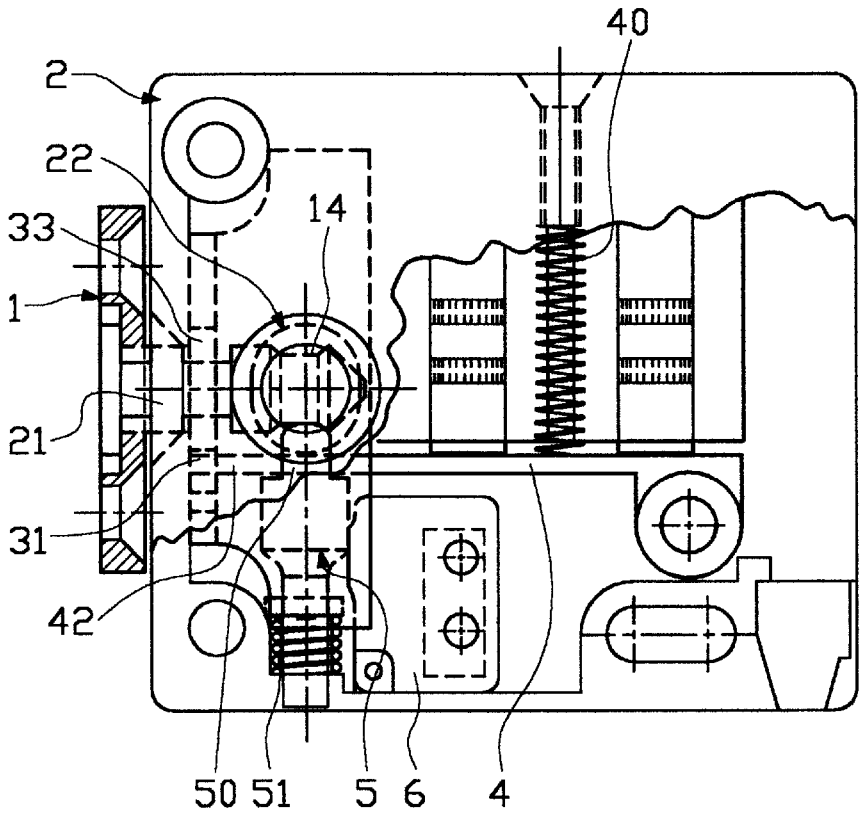
Figure 4:
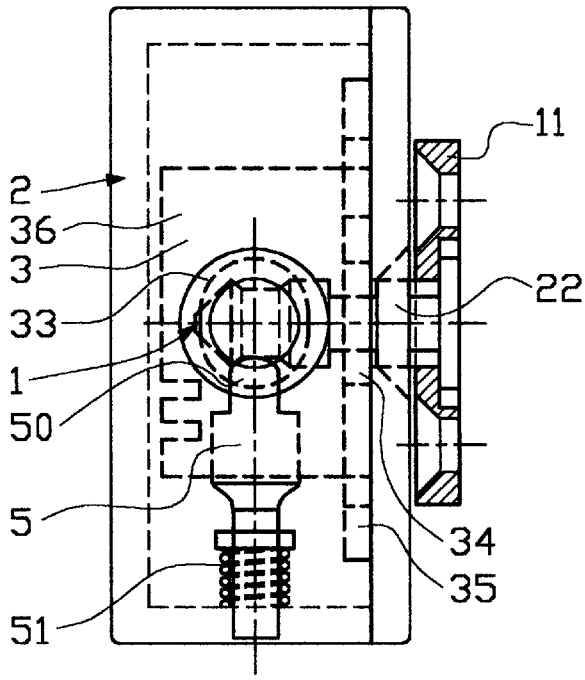
Figure 5:
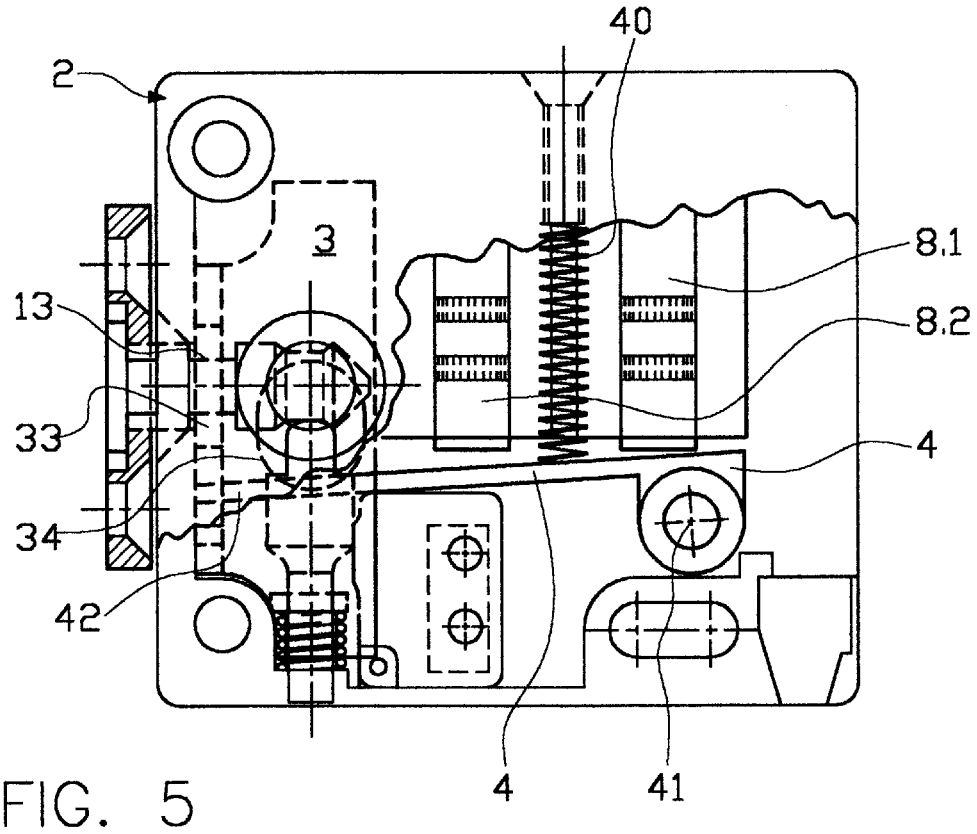
Figure 6:
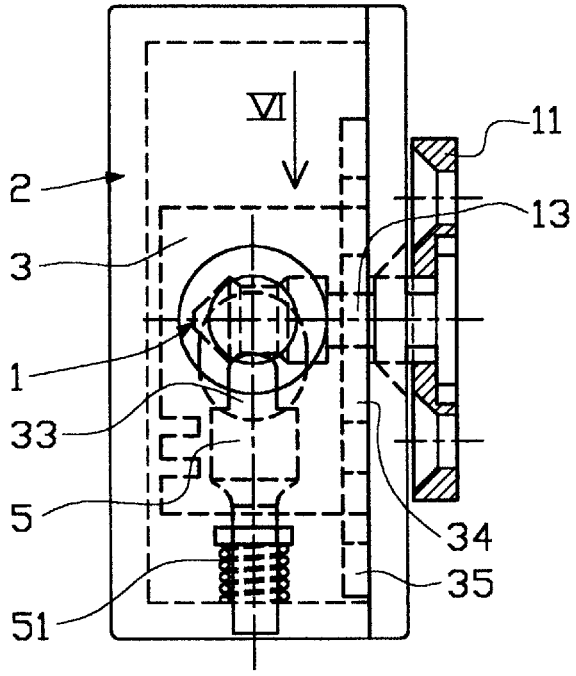
Figure 7:
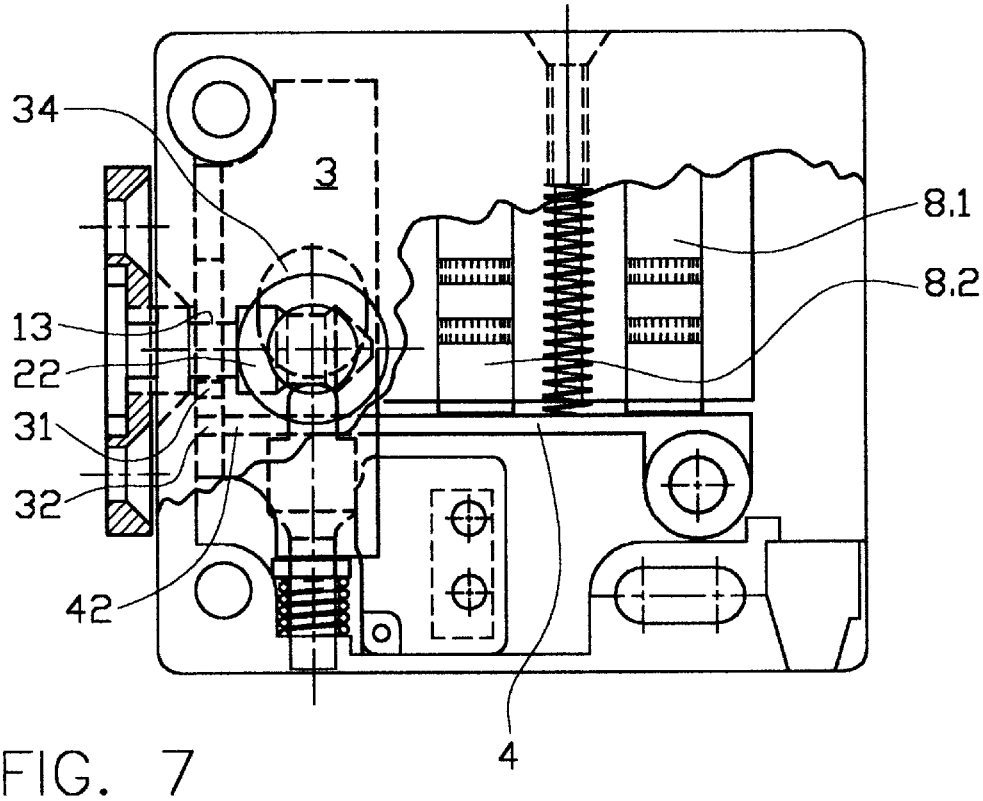
Figure 8:
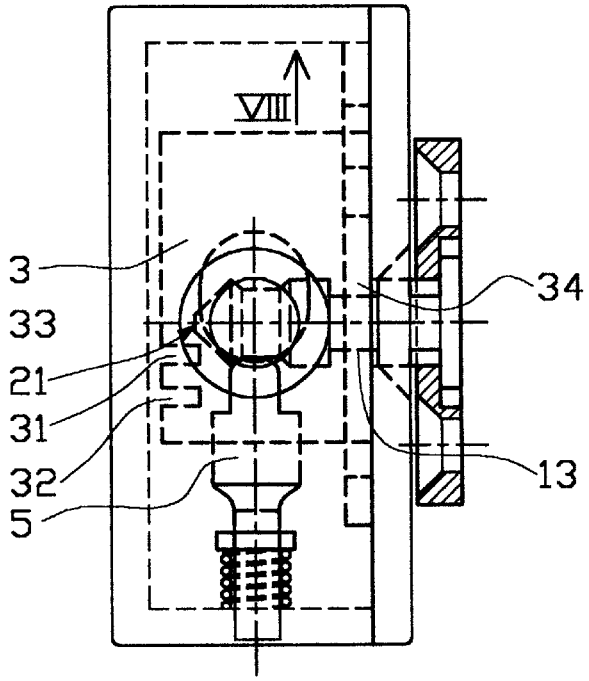
Figure 9:
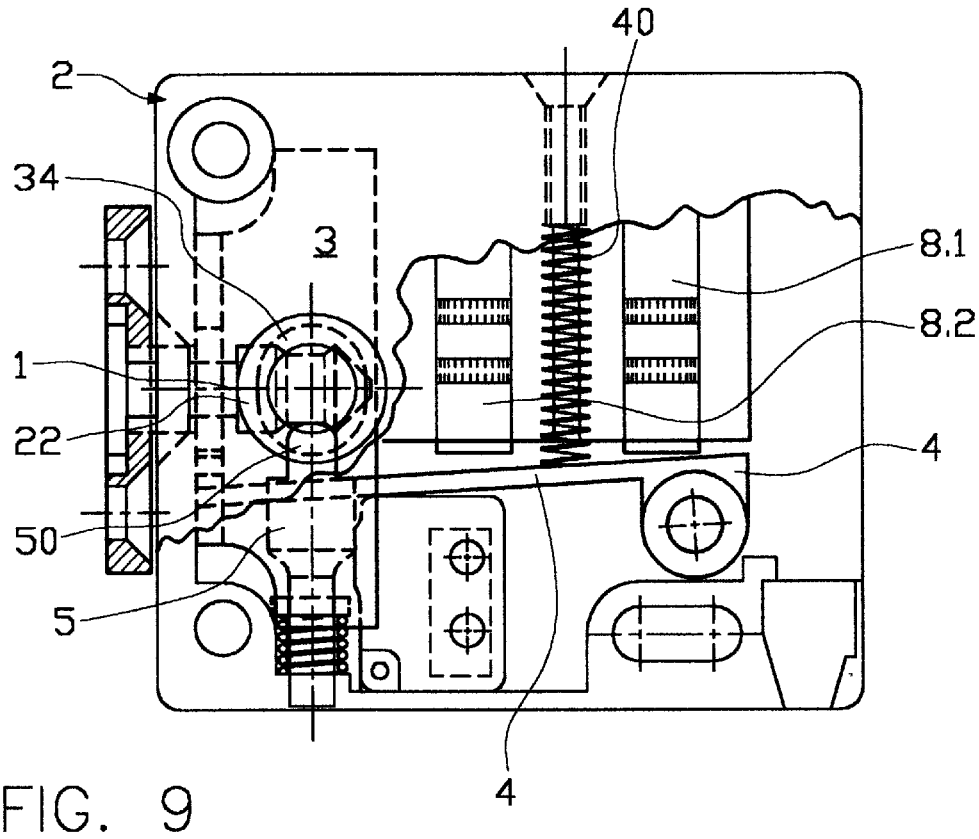
Figure 10:
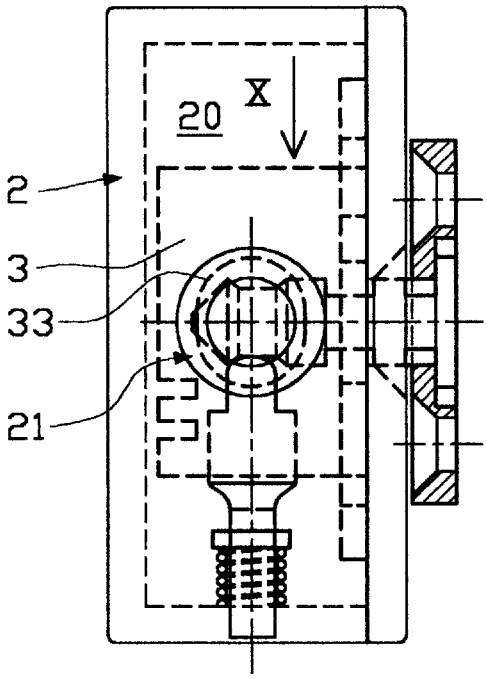
Figure 11:
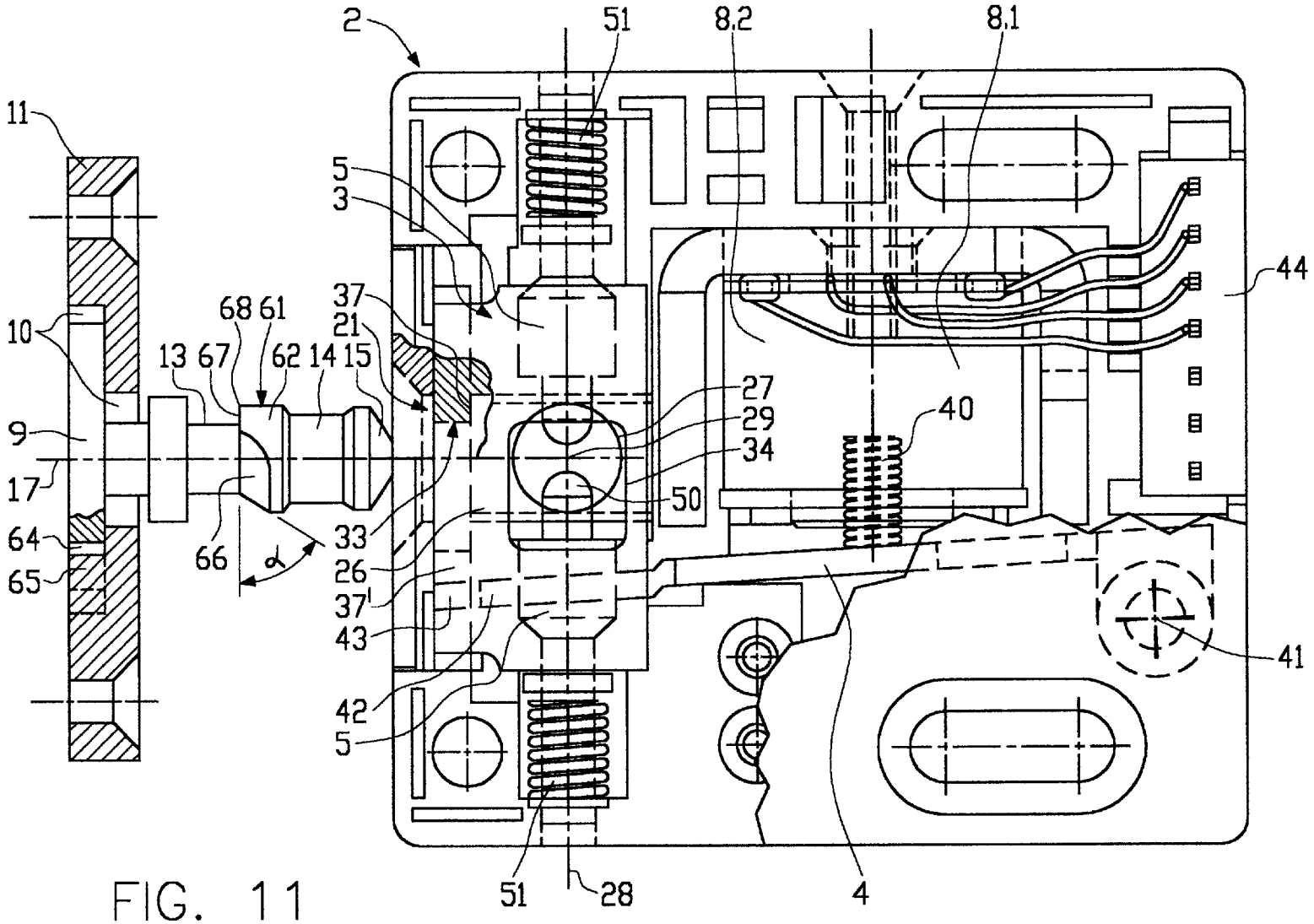
Figure 12D:
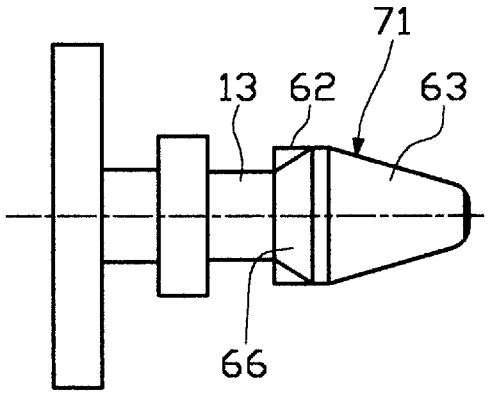
Figure 12C:
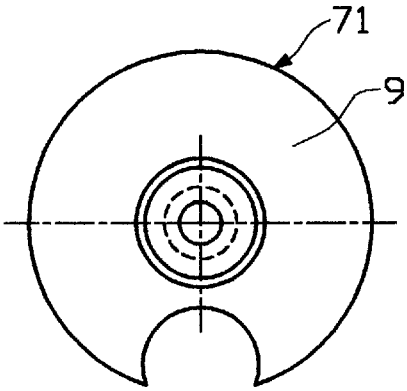
Figure 12A:
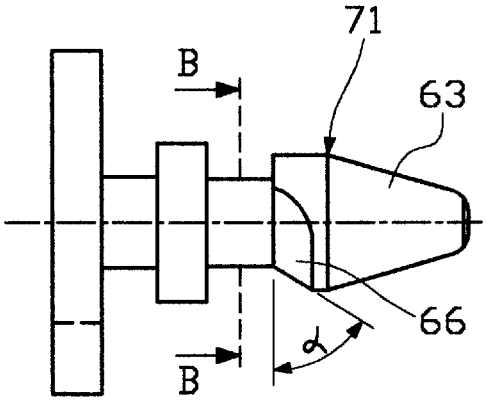
Figure 12B:
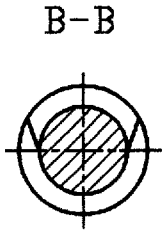

FIG. 1 shows a view of an inventive locking device with a locking housing, of which part of the cover plate has been removed, having a locking pin arranged on the end side and outside the locking housing;

FIG. 2 shows an end view of the locking housing in accordance with arrow II according to FIG. 1, having a locking pin arranged in the region of the cover plate and outside the locking housing;

FIG. 3 shows a locking device according to the invention with a locking pin which has been introduced on the end side and is in the unlocked position (open-circuit principle);

FIG. 4 shows an end view of the locking housing with a locking pin which has been introduced on the cover-plate side and is in the unlocked position (open-circuit principle);

FIG. 5 shows a locking device according to the invention with a locking pin which has been introduced on the end side and is in the locked position (open-circuit principle);

FIG. 6 shows an end view of the locking housing with a locking pin which has been introduced on the cover-plate side and is in the locked position (open-circuit principle);

FIG. 7 shows a locking device according to the invention with a locking pin which has been introduced on the end side and is in the locked position (closed-circuit principle);

FIG. 8 shows an end view of a locking housing with a locking pin which has been introduced on the cover-plate side and is in the locked position (closed-circuit principle);

FIG. 9 shows a locking device according to the invention with a locking pin which has been introduced on the end side and is in the unlocked position (closed-circuit principle);

FIG. 10 shows an end view of the locking housing with a locking pin which has been introduced on the cover-plate side and is in the unlocked position (closed-circuit principle);

FIG. 11 shows, in a side view according to FIG. 1, a further exemplary embodiment of the locking device according to the invention;

FIGS. 12(*a*) to 12(*d*) show four views of a further embodiment of a locking pin for the locking device illustrated in FIG. 11; and FIGS. 13(*a*) to 13(*d*) show four views of the locking pin of the locking device illustrated in FIG. 11.

The inventive locking device according to FIGS. 1 and 2 has a locking pin 1 as a locking element and a locking housing 2 as a locking-element socket as well as a locking slide 3 which is received in said housing. The locking housing 2 is of approximately cuboidal design and is closed at the front, or top side by a cover plate 23.

In FIGS. 1, 3, 5, 7 and 9, part of the cover-plate 23 has been removed in a bottom right-hand region. Moreover, it is only those features which are necessary for understanding the locking device which are illustrated. The locking housing 2 has two introduction openings 21, 22 for optional arrangement of the locking device or locking pin 1. Both the end introduction opening 21 and the second introduction opening 22 in the cover plate 23, said second introduction opening being arranged at the same height and at the same distance from a left-hand housing edge, are respectively aligned with sockets 33 and 34 in the locking slide 3, which in this exemplary embodiment is arranged in the left-hand end region of the locking housing 2. The two sockets 33, 34 for an optionally arranged locking pin 1 are designed as slots. The introduction openings 21, 22, aligned with the slots 33, 34 in FIGS. 1 and 2, of the locking housing 2 run conically in the direction of the interior and of the locking slide 3.

The locking slide 3 is guided displaceably on the inside of the cover plate 23 by way of a securing plate 35 and, as can be gathered from FIG. 1, has arcuate recesses on the left which correspond to the fastening regions 25 of the locking housing 2.

FIG. 2 shows that the locking slide 3 is designed to be of approximately the same depth as the interior of the locking housing 2. Actuation of the locking slide 3 takes place electromagnetically with the aid of a set of coils 8.1 and 8.2 and an armature 4, which interacts with the set of coils 8.1, 8.2. This armature 4 is designed as a single-arm lever, of which the pivot axis 41 is arranged approximately in the region of the right-hand coil 8.1. The armature 4 can be arranged, for example suspended in an open-circuit groove 31 or in a closed-circuit groove 32 by way of a free end region 42. The open-circuit and closed-circuit grooves 31, 32 are designed, in a rear region 36 of the locking slide 3, to be approximately complementary to the end region of the armature 4. In FIG. 1, the bar-like armature 4 has been suspended, for closed-circuit operation, in the closed-circuit groove 32. Suspension of the armature 4 in the closed-circuit groove 32 or open-circuit groove 31 means that the locking device can be changed over as required. With the no-current closed-circuit operation in FIG. 1, the locking pin 1 can be introduced. In FIG. 1, the locking pin 1 is introduced into the slot 33 of the locking slide 3 via the end side 20 and the introduction opening 21, and in FIG. 2 it is introduced into the slot 34 of the locking slide 3 via the introduction opening 22 in the cover plate 23 of the locking housing 2.

In the present exemplary embodiment, the locking pin 1 is received "with play" in a cutout 10 of a fastening flange 11, the cutout 10 being designed in the form of a step corresponding to a fastening foot 9 of the locking pin 1. The relatively large diameter of the cutout 10 permits displacement of the locking pin 1 in the fastening flange 11, thus ensuring tolerance compensation. Fastening of the locking pin 1 in the fastening flange 11 can take place in a known manner.

In the region of the fastening flange 11, the locking pin 1 is fastened on the corresponding furniture part via fastening openings 12. It is usually the case that the locking pin 1 is arranged on a movable furniture part, while the locking housing 2 with locking slide 3 and an indicator element 5 is fastened on a fixed furniture part. However, it is also possible for this arrangement to be swapped round.

The locking pin 1 has two grooves 13, 14 in a cylindrical region. The first of these grooves is a locking groove 13, in which the locking slide 3 engages when it is displaced into a locking position with the aid of the armature 4. An indicator groove 14 is provided in the vicinity of a head-side introduction region 15, which is in the form of a truncated cone, and serves for receiving the indicator element 5. The frustoconical introduction region 15 permits, by way of the introduction slopes, introduction into the introduction openings 21, 22 even with utilization of a tolerance region in the case of the displaceable arrangement in the cutout 10.

The indicator element 5 is designed as an indicator slide which is arranged so as to be vertically displaceable counter to the force of an indicator spring 51, which is supported on the housing 2. Whenever a locking pin 1 is introduced through the end introduction opening 21 or through the cover-plate introduction opening 22, the indicator element 5, resting in the indicator groove 14, is forced downward. It thus also assumes a latching-in function in addition to the monitoring function. As it is being forced downward, the indicator element 5 activates a microswitch 6, which is arranged immediately beside the indicator element 5 and can be connected to an alarm or monitoring system.

The illustrations in the following FIGS. 3 to 10, correspond to FIGS. 1 and 2 as far as the design of the locking device is concerned. These figures merely illustrate different operating states, and the same designations are therefore used for the same features in the following figures.

FIG. 3 shows a locking pin 1 which has been introduced into the locking housing 2, the locking pin 1 having been introduced into the end introduction opening 21 of the locking housing 2 and into the end socket or the slot 33 of the locking slide 3. The cover-plate introduction opening 22 is used in the locking arrangement according to FIG. 4. In FIG. 3, this cover-plate introduction opening 22 makes it possible to see the interaction of the indicator element 5 and the indicator groove 14 of the locking pin 1. The virtually spherical head 50 of the indicator element 5 engages in the indicator groove 14 and assumes a certain latching function. FIG. 3 and FIG. 4 show that, in that position of the locking slide 3 which is illustrated, the locking pin 1 is not locked and can therefore be drawn out of the locking slide 3 and the locking housing 2 without obstruction. With such an arrangement, a drawer or a door can be opened.

The locking device according to FIGS. 3 and 4 operates in accordance with the open-circuit principle, because the armature 4 is arranged with its end region 42 in the open-circuit groove 31. The set of coils 8.1, 8.2 has been supplied with current and activates the armature in the direction counter to the force of an armature spring 40.

The functioning of the indicator element 5 becomes clear upon comparison of FIGS. 1, 3 and 2, 4. While the indicator element 5 in FIGS. 1 and 2 cannot be forced downward because the locking pin 1 has not been introduced, the indicator spring 51 in FIGS. 3 and 4 and in the rest of the figures is compressed and the hemispherical head 50 rests in the indicator groove 14.

FIGS. 5 and 6 show the locking device according to FIGS. 3 and 4, but the coils 8.1 and 8.2 have not been supplied with current. The armature 4 is forced downward by the armature spring 40, and the locking slide 3 is adjusted downward by way of the end region 42 of the armature 4. This adjustment can be seen, in particular, from the position of the securing plate 35 and of the slots 33, 34. At the same time, it becomes clear that the locking pin 1, with its locking groove 13 is arranged eccentrically in the respective slot 33, 34 and a blocking position has been reached. In the operating state of FIGS. 5 and 6, the locking pin 1 cannot be drawn out. The corresponding drawer or door are locked and cannot be opened. It is only when the set of coils 8 has been supplied with current again, and when the armature 4 according to FIGS. 3 and 4 is activated, that the locking slide 3 is adjusted upward again, that is to say in the direction counter to the arrow VI according to FIG. 6, with the result that the locking position of the locking slide 3 is overcome.

FIGS. 7 to 10 show a locking device in accordance with the closed-circuit principle. The armature 4 is suspended in the closed-circuit groove 32 by way of its free end region 42 (see FIGS. 7 and 9). The current-carrying set of coils 8.1 and 8.2 activates the armature 4, according to FIG. 7, and as a result the locking slide 3 is displaced upward (see arrow VIII in FIG. 8). The respective slot 33 or 34 is no longer aligned with the adjacent introduction opening 21, 22 of the locking housing 2, but rather blocks the path of the locking pin 1 in the region of the locking groove 13, with the result that said pin cannot be drawn out of the locking housing 2. When the set of coils 8.1, 8.2 is not supplied with current (see FIGS. 9 and 10), the armature spring 40 forces the armature 4 downward and, with it, the locking slide 3 is moved downward (see arrow X in FIG. 10). The slot 33 in the end side 20 of the locking slide 3 is aligned with the end introduction opening 21 of the locking housing 2, and the slot 34 and the introduction opening 22 are likewise aligned (FIG. 9). It is possible for the locking pin 1 to be drawn out. As said pin is being drawn out, it is not obstructed in any way by the indicator element 5 with its hemispherical head 50. Moreover, the locking pin 1 is of bevelled design in the region of the indicator groove 14, with the result that it can slide over the indicator element 5 as it is guided out of the housing.

A further exemplary embodiment of the locking device according to the invention is illustrated in FIG. 11. The ways in which this locking device differs from the previous examples are described in more detail hereinbelow.

The locking pin 61 of this locking device (see also FIGS. 13*a* to 13*d*) is constructed in largely the same way as the locking pin 1, which is illustrated in FIGS. 1 and 2. It has a cylindrical central section 62, which is adjoined, toward the tip of the pin, by an annular indicator groove 14 and a head-side introduction region 15, which is in the form of a truncated cone. The central section 62 is adjoined, in the direction of the fastening foot 9, by the locking groove 13, which has already been described. The fastening foot 9 is received with radial play in the step-like cutout 10 of the fastening flange 11. In the circular fastening foot 9, a recess 64, for example a semicircular milled section, extends radially inward from the circumference (see FIG. 13*c*). The fastening flange 11 has a nose 65 which corresponds to the recess 64, is designed to project toward the longitudinal axis in the cutout 10 and engages with play in the recess 64 on the fastening foot 9 of the locking pin 61. When the fastening flange 11 has been screwed tight, the locking pin 61 is thus secured against turning about its longitudinal axis.

Figure 13D:
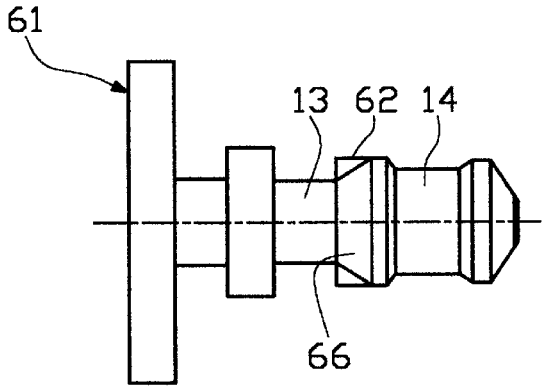
Figure 13C:
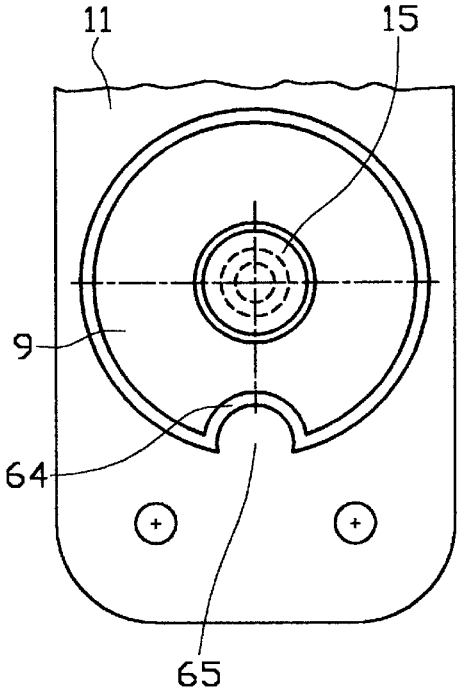
Figure 13A:
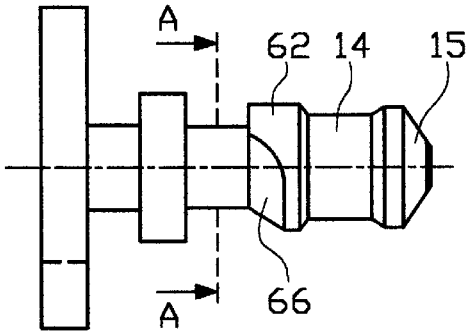
Figure 13B:
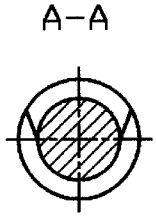

Toward the locking groove 13, the cylindrical central section 62 has a bevel 66 with an angle $\alpha$ of, for example, 60°, the bevel 66 being formed over approximately 180° on the circumference of the central section 62 (see FIG. 13*b*). Otherwise, a locking surface 67 with a circumferential edge 68 remains on the side of the central section 62.

The locking slide 3 is guided displaceably in the locking housing 2 in the manner which was described by way of the first exemplary embodiment. In the bottom position (illustrated), it is retained by the armature 4 which is suspended, at its free, front end 42, in a recess 43 in the locking slide 3 and is forced downward, about its pivot axis 41, via the armature spring 40 when coils 8.1 and 8.2 have not been supplied with current.

In this exemplary embodiment, the two sockets 33, 34 of the locking slide 3 are illustrated as rectangular recesses with rounded corners. An inner receiving space in a central part of the locking housing 2 for the inserted locking pin 61 is formed by two bores 26 and 27 which intersect at right angles and are respectively arranged coaxially with the end introduction opening 21 and the cover-side introduction opening 22 (not depicted in FIG. 11).

On a common axis 28, which leads through the point of intersection 29 of the two bores 26 and 27, two indicator elements 5 or slides are arranged opposite one another in the locking housing 2. Each indicator element 5 is forced, by an indicator spring 51, into the illustrated position, in which the virtually spherical head 50 projects into the receiving space, formed by the bores 26, 27, for the locking pin 61.

When a furniture door or the like which has been equipped with the locking device illustrated is closed, then, depending on the arrangement, the locking pin 61 is pushed through the end introduction opening 21 or the cover-side introduction opening 22 and the associated socket 33 or 34, respectively, in the locking slide 3. In this case, the frustoconical introduction region 15, in accordance with the illustration in FIG. 11, forces the top side of the socket 33 (this is indicated by the arrow designated 33), and thus the locking slide 3, upward until, in the fully pushed-in, closed position, the central section 62 of the locking pin 61 is arranged within the locking slide 3, with the result that the locking slide 3, which is subjected to spring prestressing by the armature 4, is forced downward and its locking protrusion 37 engages in the locking groove 13. Furthermore, the spherical heads 50 of the two indicator elements 5 have first of all been forced outward, counter to the force of the indicator springs 51, by the frustoconical introduction region 15 and are then latched in the indicator groove 14, in the closed position. Since the locking protrusion 37 butts axially against the locking surface 67 of the locking pin 61, the locking pin 61 cannot be drawn out of the locking housing 2.

For unlocking purposes, the coils 8.1 and 8.2 are supplied with current and activate the armature 4, as a result of which the locking slide 3 is pushed upward (according to FIG. 11). The locking protrusion 37, which moves along therewith, is drawn back out of the locking groove 13 of the locking pin 61, with the result that the axially directed, mechanical blocking is then eliminated and the locking pin 61 is retained merely by the indicator elements or slides 5, which have a latching function. This realizes locking and unlocking in accordance with the open-circuit principle (locked when not supplied with current).

The exemplary embodiment illustrated makes it possible for the locking device to be used alternatively in accordance with the closed-circuit principle (unlocked when not supplied with current). For operation in accordance with the closed-circuit principle, the locking pin 61 is fitted in a position in which, together with the fastening flange 11, it is arranged so as to be turned through 180° about its longitudinal axis 17 in relation to the illustration in FIG. 11. Both the bevel 66 and the recess 64 as well as the nose 65 are then arranged on the opposite side (the top side according to FIG. 11).

When, then, the locking pin 61 is pushed in through the end introduction opening 21 and the associated socket 33 in the locking slide 3, then, with simultaneous displacement of the locking slide 3, the top side of the socket 33 slides over the frustoconical introduction region 15, the indictor groove 14, the narrow central section and the bevel 66 until it is located in the locking groove 13. At the same time, the indicator elements 5 are latched in the indicator groove 14. In this case, rather than butting against the locking surface 67 in a blocking manner, the locking protrusion 37 can slide on the bevel 66, as the locking pin 61 is drawn out, and pushes the locking slide 3 upward.

For the purpose of locking the locking pin 61, the set of coils 8.1 and 8.2 is supplied with current. The armature 4 displaces the locking slide 3 into its top position. Thereafter, the locking protrusion 37', located opposite at the socket 33, engages in the locking groove 13 and, at the locking surface 67, forms a mechanical blocking means against the locking pin 61 being drawn out.

A further exemplary embodiment of the locking device according to the invention has a locking pin 71, according to FIGS. 12*a* to 12*d*, which in contrast to the locking pin 61, illustrated in FIGS. 13*a* to 13*d*, has on its front section, from the central section 62 toward the tip of the pin, a conical introduction section 63 with a cone angle of, for example, 30°. With the arrangement and functioning otherwise being comparable to those of FIG. 11, the locking pin 71, once pushed into the locking housing 2, is kept locked in the manner described, by the blocking contact between the locking protrusion 37 and the locking surface 67, in accordance with the open-circuit principle (locked when not supplied with current).

When the set of coils 8.1 and 8.2 is supplied with current, the locking slide 3 is pushed upward by the armature 4, with the result that the axial blocking is eliminated. By virtue of the two indicator elements 5, which have their heads 50 forced, under prestressing, by the springs 51 against the conical introduction section 63 of the locking pin 71 in the radial direction, an axial force component is exerted on the conical introduction section 63, as a result of which, depending on the installation situation, the locking pin 71 is forced out of the housing 2 by a certain distance.

Supplying the set of coils 8.1 and 8.2 with current thus results not just in unlocking, but also in the locking pin 71 being forced out, this providing a visual indication of the unlocking position.

In this exemplary embodiment, only the open-circuit principle is used, the locking pin 71 being fitted in a position with the bevel 66 beneath the longitudinal axis 17 (see FIG. 11). With the closed-circuit principle (open when not supplied with current), the unlocked locking pin 71, once pushed into the housing 2, would immediately be forced out again by the two spring-loaded indicator elements 5.

The housing 2 illustrated in FIG. 11 has a coil former with two coils 8.1 and 8.2 in an arrangement for optional series connection (24 V) or parallel connection (12 V). In accordance with these two arrangements, the coils are connected to four terminals of contact strips 44. The desired arrangement is selected by appropriately connecting power leads to the contact strip 44.

Instead of the two indicator elements 5 described, it is also possible, while maintaining the same functioning, for just one indictor element 5 to be provided. A microswitch for sensing the position may be provided on one indicator element 5 or on the two indictor elements 5.

What is claimed is:

1. A locking device for furniture, said locking device having:

a locking element affixable to a first furniture part, said locking element comprising a locking pin;

a locking-element socket affixable to a second furniture part, said locking-element socket comprising a locking housing containing a locking slide, which is movable electromagnetically from a locking position that locks the locking element, into an unlocking position that unlocks the locking element, said locking-element socket further comprising a first introduction opening, and a second introduction opening disposed substantially perpendicular to said first introduction opening, said locking slide having a first socket and a second socket, each of said first introduction opening, second introduction opening, first socket and second socket intended for said locking pin, and a monitoring device, which comprises an indicator element arranged at a point of intersection substantially coincident of axes of intersection of each introduction opening of said locking housing and each socket of said locking slide, respectively.

2. The locking device as claimed in claim 1, wherein the locking housing is designed as a cubic compact housing having an end side and an adjoining cover plate, wherein said first introduction opening is formed in said end side, and said second introduction opening is formed in said adjoining cover plate of the locking housing, and wherein the locking slide is arranged and adjusted on an inside, in a region of the first and second introduction openings, of said locking housing.

3. The locking device as claimed in claim 1, wherein said locking slide is displaceably guided on at least one inner side of a locking housing wall, and wherein said first socket and said second socket are designed as slots and, in said unlocking position, said first socket is in alignment with said first introduction opening as said second socket is in alignment with said second introduction opening of said locking housing in order to receive said locking pin.

4. The locking device as claimed in claim 1, wherein said locking slide is actuated by an armature and adjusted from said unlocking position into said locking position, said armature connected to the locking slide for actuation from a closed-circuit operation to an open-circuit operation.

5. The locking device as claimed in claim 4, where said armature is designed as a single-arm lever armature, which pivots about a pivot axis that runs parallel to an end side of said locking housing, and wherein at least one coil of an electromagnet is arranged in a vicinity of the pivot axis, and a free end region of said armature is releasably fixed in an open-circuit groove or closed-circuit groove of said locking slide.

6. The locking device as claimed in claim 5, wherein the open-circuit groove and the closed-circuit groove are designed to complement the free end region of the armature, and are arranged at a predeterminable distance one above the other in a rear region of said locking slide.

7. The locking device as claimed in claim 1, wherein said locking slide includes a securing plate which, for guidance during adjusting movement of the locking slide, is attached to an inside of a cover plate of said locking housing.

8. The locking device as claimed in claim 1, wherein the indicator element is designed as a spring-biased indicator slide that is arranged displaceably in the locking housing, said indicator element being received, at least in part, by said locking slide, and is formed with a hemispherical head disposed, when unbiased, at a point of intersection coincident of both axes of intersection of each introduction opening of said locking housing.

9. The locking device as claimed in claim 1, further including a switch arranged adjacent to said indicator element such that when a locking pin is introduced through said first introduction opening, the switch is actuated and an alarm system is optionally actuated.

10. The locking device as claimed in claim 1, wherein the locking pin projects from a fastening flange having fastening openings and is designed as a circular cylinder, said locking pin having an annular locking groove, which engages said locking slide in a locking position, and having an annular indicator groove, which engages a hemispherical head of said indicator element.

11. The locking device as claimed in claim 1, wherein said locking housing and the adjustable locking slide is affixed to a stationary furniture part, and the locking pin is affixed to a movable furniture part.

12. The locking device as claimed in claim 10, wherein the locking pin is fixed displaceably in a cutout of said fastening flange.

13. The locking device as claimed in claim 10, wherein the annular locking groove is formed in a vicinity of the fastening flange, and the annular indicator groove is formed in a vicinity of a front, introduction region of said locking pin.

14. A locking device for locking and unlocking two components moveable relative to one another, in particular doors or drawers of furniture, said locking device having:

a locking element affixable to a first component, said locking element comprising a locking pin having a longitudinal axis, and a locking-element socket affixable to a second component and movable from a locking position that locks the locking element, into an unlocking position that unlocks the locking element, said locking-element socket comprising a locking housing containing an electrically actuable locking slide having a first socket and second socket intended for said locking pin, and setting relative positions of interacting locking parts of said locking pin and of said locking slide optionally sets an open-circuit operation, in which said locking pin is locked when an actuation device has not been supplied with current, and optionally sets a closed-circuit operation, in which the locking pin is unlocked when said actuation device has not been supplied with current.

15. The locking device as claimed in claim 14, said locking pin having an annular locking surface and a beveled section connecting said locking surface, wherein turning of said locking pin about said longitudinal axis, prior to closure of said locking device, optionally positions said locking surface and said beveled section into a locking position and unlocking position on a locking protrusion on said locking slide.

16. The locking device as claimed in claim 15, wherein, during fitting, turning of the locking pin is determined by alignment of a fastening flange.

17. The locking device as claimed in claim 14, wherein said locking pin which, in the unlocking position, is forced out of the locking position by at least one spring-actuated element disposed within said locking housing, in setting an open-circuit operation.

18. The locking device as claimed in claim 14, wherein the electric actuation device has a coil former with two coils connected at least one of in series and in parallel.

19. The locking device as claimed in claim 14, wherein said locking slide is actuable by an armature of the electric actuating device and is adjustable from an unlocking position into a locking position, said armature, via connection to the locking slide, optionally switches over from a closed-circuit operation to an open-circuit operation.

20. The locking device as claimed in claim 14, said locking housing having a first introduction opening and a second introduction opening disposed substantially perpendicular to said first introduction opening, said locking slide having a first socket and a second socket disposed substantially perpendicular to said first socket, each of said first introduction opening, second introduction opening, first socket and second socket intended for said locking pin.

21. The locking device as claimed in claim 20, further comprising a monitoring device, which comprises at least one indicator element that extends into a region at a point of intersection coincident of both axes of intersection of each introduction opening of said locking housing.

22. The locking device as claimed in claim 10, wherein an introduction region of said locking pin is designed as a truncated cone.

* * * * *